United States Patent [19]

Harrington

[11] Patent Number: 4,605,902

[45] Date of Patent: Aug. 12, 1986

[54] HYBRID JUNCTION SIGNAL COMBINER

[75] Inventor: Timothy A. Harrington, Cedar Rapids, Iowa

[73] Assignee: Rockwell International Corporation, El Segundo, Calif.

[21] Appl. No.: 414,751

[22] Filed: Sep. 3, 1982

[51] Int. Cl.[4] ..... H01P 5/12; H01P 5/22; G06G 7/12

[52] U.S. Cl. ..... 328/158; 333/117; 333/109; 307/529; 455/326

[58] Field of Search ..... 328/158, 159, 160, 165, 328/162, 163, 156; 307/520, 529, 472, 498, 296; 455/323, 325, 326; 367/124, 125; 333/100, 101, 117, 120, 121, 122, 109, 112, 118

[56] References Cited

U.S. PATENT DOCUMENTS

| | | | |
|---|---|---|---|
| 2,914,249 | 11/1959 | Goodall | 333/117 |
| 3,157,781 | 11/1964 | Gruen | 367/125 |
| 3,794,926 | 2/1974 | Skingley et al. | 328/163 |
| 3,827,051 | 7/1974 | Foldes | 333/117 |
| 3,831,097 | 8/1974 | Neuf | 455/302 |
| 3,986,124 | 10/1976 | Mitchell, Jr. | 455/137 |
| 4,017,859 | 4/1977 | Medwin | 367/125 |
| 4,080,579 | 3/1978 | Fassett | 333/117 |
| 4,177,430 | 12/1979 | Paul | 455/306 |
| 4,408,352 | 10/1983 | Dudding | 455/305 |
| 4,450,585 | 5/1984 | Bell | 455/303 |

*Primary Examiner*—Stanley D. Miller
*Assistant Examiner*—Timothy P. Callahan
*Attorney, Agent, or Firm*—R. K. Robinson; George A. Montanye; H. Fredrick Hamann

[57] ABSTRACT

Isolation is provided to two signal sources whose output signals are combined by the use of an outphasing technique. A first divider divides the signal from a first signal source into two signals and a second divider divides the signal from the second signal source into two additional signals. A first output of the first divider and a first output of the second divider are connected together by an attenuator and delay line which is used to cancel the leakage across a hybrid combiner. A second output of the first divider and second divider is applied to the hybrid combiner where the two signals are combined to obtain a combination signal that has enhanced isolation.

6 Claims, 2 Drawing Figures

HYBRID JUNCTION SIGNAL COMBINER

BACKGROUND OF THE INVENTION

This invention relates to signal combiners that are used to combine two signals while providing isolation to the signal sources.

The prior art method of combining two signals from two separate signal sources usually resulted in distortion due to lack of sufficient isolation between the signal sources even when state of the art hybrid junctions were used to implement the combining function.

SUMMARY OF THE INVENTION

Isolation is provided to two signal sources whose output signals are combined by the use of an outphasing technique described herein. A first divider divides the signal from a first signal source into two signals and a second divider divides the signal from the second signal source into two additional signals. A first output of the first divider and a first output of the second divider are connected together by an attenuator and delay line which is used to cancel the leakage across a hybrid combiner. A second output of the first divider and a second output of the second divider is applied to the hybrid combiner where the two signals are combined to obtain a combination signal that has enhanced isolation.

It is the object of this invention to provide a signal combiner that provides enhanced isolation between the signal sources that provide the signals that are to be combined.

It is another object of the invention to provide a signal combiner that utilizes outphasing techniques to increase isolation between the signal sources.

It is yet another object of the invention to provide a combiner circuit that may be used to combine a plurality of signal sources.

It is still yet another object of the invention to provide a combiner that may be effectively used to measure the low level nonlinearity of a circuit without interjection of distortion caused by the combination of two signal sources.

BRIEF DESCRIPTION OF THE DRAWINGS

In order that the invention may be readily carried into practice, a number of embodiments will now be described in detail by way of example, with reference to the accompanying drawings in which.

DETAILED DESCRIPTION OF THE PREFERRED EMBODIMENT

Figure 1:
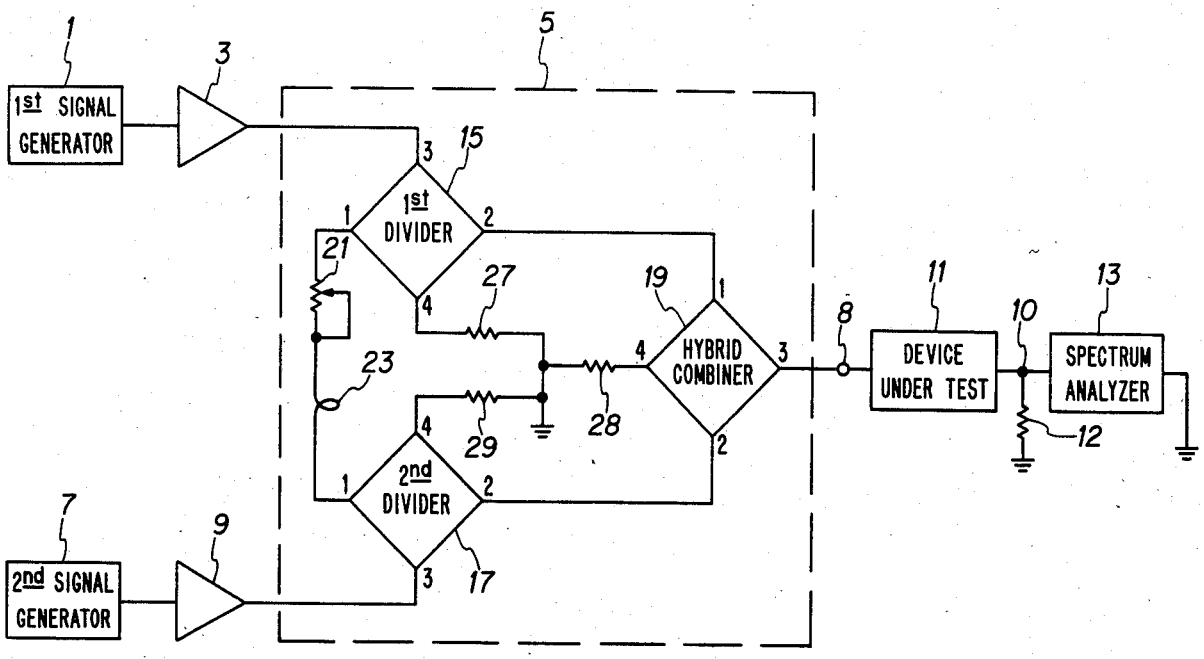
FIG. 1 is a block diagram of a test configuration that utilizes the combiner according to the invention.

In FIG. 1, to which reference should now be made, there is shown an apparatus for measuring the nonlinearity of a circuit such as a power amplifier. A first tone is provided by a first generator 1 to a power amplifier 3 which amplifies the tone and applies it to a combiner 5 where the first tone is combined with a second tone that is provided by a second signal generator 7 and amplified by a second power amplifier 9. The two tones are applied after being combined to a device under test 11 which drives a load 12. The nonlinearity of the device under test 11 is measured by a spectrum analyzer 13 which will indicate distortion tones which are present at node 10 (the output of the device under test 11). However, unless proper isolation is provided by the combiner 5 then the same distortion tones may be present at node point 8. Consequently the spectrum analyzer 13 will indicate, erroneously, that the device under test 11 has a certain degree of nonlinearity.

To provide isolation between the power amplifier 3 and the power amplifier 9 and to avoid the erroneous indication of nonlinearity, the combiner 5 has a first divider 15 and a second divider 17. Both the first divider 15 and the second divider 17 are four port networks such as hybrid junctions. The signal that is provided by the power amplifier 3 to the first divider 15 is divided into first and second output signals that are present at output terminals 1 and 2, respectively. Similarly, the signal that is applied to the input terminal of the second divider 17 is divided into two signals that are applied to its first and second output terminals. The second output terminals of the first divider 15 and the second divider 17 are connected to the first and second input terminals of a hybrid combiner 19 where the two signals from the first signal generator 1 and the second generator 7 are combined into a single signal that appears on terminal 3 of the hybrid combiner 19. The hybrid combiner 19 is also a four port network with two input ports and two output ports. The first terminals of the first divider 15 and the second divider 17 are connected together via an attenuator 21 and a delay line 23. The attenuator 21 and the delay line 23 are used to cancel leakage across the hybrid combiner 19. Thus, the leakage of the signal on terminal 1 of the hybrid combiner 19 that is a portion of the signal on terminal 2 of the hybrid combiner 19 is cancelled at terminal 3 of the first divider 15. Similarly, the leakage of the signal on terminal 2 of the hybrid combiner 19 that is a portion of the signal on terminal 1 of the hybrid combiner 19 is cancelled at terminal 3 of the second divider 17. Resistors 27, 28 and 29 are used for the termination of the fourth port of the first and second dividers 15 and 17 and the hybrid combiner 19.

The utilization of the combiner 5 provides outphasing which results in an increase in isolation between the power amplifier 3 and the power amplifier 9. Outphasing essentially provides an alternate path for the signal to get from the first signal generator 1 to the second signal generator 7 and vice versa. The alternate path is selected such that it is of the same amplitude and in phase opposition to the primary path and therefore cancels out the effects of the first path, i.e., outphases the first path.

Figure 2:
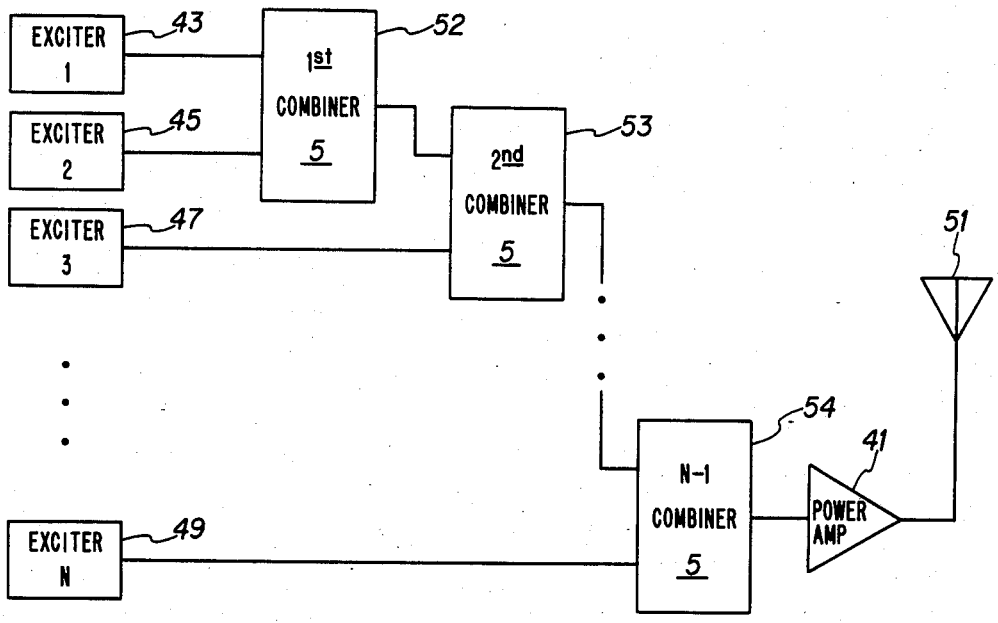
FIG. 2 is a block diagram of a broadband transmission system according to the invention.

FIG. 2 is a communication link that provides a wide range of frequencies upon which information is transmitted between two stations. A broadband amplifier 41 amplifies a plurality of tones for transmission via antenna 51. The plurality of tones are provided by a first exciter 43, second exciter 45 through an nth exciter 49. The tones may be modulated radio signals that are used to transmit data between stations. The first exciter 43 and the second exciter 45 are combined by a first combiner 52, the output of which is combined with a third exciter 47 by a second combiner 53 and the nth exciter 49 is combined with a signal from the nth exciter by the (n-31 1) combiner 54. Each of the combiners 51, 53 and 54 is identical to the combiner 5 of Figure 1. The combined signals are amplified by the broadband power amplifier 41 and transmitted by the broadband antenna 51.

Many changes and modifications in the above described invention can, of course, be carried out without departing from the scope thereof. Accordingly, the invention is intended to be limited only by the scope of the appended claims.

I claim:

1. A signal combiner for providing isolation between two signal sources that provide a first signal and a second signal, the combiner comprises:

a first divider means for dividing the first signal into a third and fourth signal;

a second divider means for dividing the second signal into a fifth and sixth signal;

cancellation means for cancelling the third and fifth signals and any leakage from the fourth and sixth signals; and a first combiner means for combining the fourth signal with the sixth signal to obtain a seventh signal that is the combination of the first and second signal.

2. The signal source isolator according to claim 1 wherein the cancellation means eans comprises a series combination of an attenuator and a delay line.

3. A method of combining a first and second signal comprising the steps of:

dividing the first signal into a third and fourth signal;

dividing the second signal into a fifth and sixth signal;

cancelling the third and fifth signals and any leakage from the fourth and sixth signals; and combining the fourth signal with the sixth signal to obtain a seventh signal that is the combination of the first and second signal.

4. A signal combiner comprising:

means for receiving a first input signal;

means for receiving a second input signal;

a first four-port hybrid divider having one port coupled to receive said first input signal and provide first and second divided outputs on other ports of said first hybrid divider;

a second four-port hybrid divider having one port coupled to receive said second input signal and provide first and second divided outputs on other ports of said second hybrid divider;

a four-port hybrid combiner having a first input port coupled to receive the first divided output from said first hybrid divider and a second input port coupled to receive the first divided output from said second hybrid divider and an output port coupled to provide a combined output of said first and second input ports of said hybrid combiner; and means for cancelling said second divided output of said first hybrid divider and said second hybrid divider and any signal leakage caused at the first and second input ports of said hybrid signal combiner.

5. The system of claim 4 wherein said means for cancelling comprises a resistor and delay line serially coupled between the second divided output of said first hybrid divider and the second divided output of said second hybrid divider.

6. A signal combiner comprising:

a first hybrid divider having first, second, third and fourth ports;

a second hybrid divider having first, second, third and fourth ports, said first port of said first and second hybrid dividers being coupled to one another through a serial connection of an attenuator and delay line, said third port of said first hybrid divider being coupled to receive a first input signal, and said third port of said second hybrid divider being coupled to receive a second input signal;

a hybrid combiner having first, second, third and fourth ports, said first port of said hybrid combiner being coupled to the second port of said first hybrid divider and said second port of said hybrid combiner being coupled to the second port of said second hybrid divider and said fourth port of said hybrid combiner being coupled to the fourth ports of said first and second hybrid dividers said third port of said hybrid combiner providing an output signal that is the combination of said first and second input signals.

* * * * *